US012655750B2

(12) United States Patent
Watson et al.

(10) Patent No.: US 12,655,750 B2
(45) Date of Patent: Jun. 16, 2026

(54) INDICATION OF COMPRESSION LOADING IN DOWNHOLE TOOL STRINGS

(71) Applicant: THRU TUBING SOLUTIONS, INC., Newcastle, OK (US)

(72) Inventors: Brock W. Watson, Sadler, TX (US); Roger L. Schultz, Ninnekah, OK (US); Brett A. Fears, Mustang, OK (US); Timothy Manke, Oklahoma City, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 218 days.

(21) Appl. No.: 17/558,926

(22) Filed: Dec. 22, 2021

(65) Prior Publication Data

US 2022/0220842 A1 Jul. 14, 2022

Related U.S. Application Data

(60) Provisional application No. 63/135,454, filed on Jan. 8, 2021.

(51) Int. Cl.

| | |
|---|---|
| ***E21B 23/08*** | (2006.01) |
| ***E21B 21/10*** | (2006.01) |
| ***E21B 34/08*** | (2006.01) |
| ***E21B 47/06*** | (2012.01) |

(Continued)

(52) U.S. Cl.

CPC ..... *E21B 47/06* (2013.01); *E21B 23/08* (2013.01); *E21B 34/08* (2013.01); *E21B 21/103* (2013.01); *E21B 34/12* (2013.01); *E21B 47/007* (2020.05)

(58) Field of Classification Search

CPC ..... E21B 21/103; E21B 34/12; E21B 47/007; E21B 47/06

See application file for complete search history.

(56) References Cited

U.S. PATENT DOCUMENTS

| | | | |
|---|---|---|---|
| 4,768,598 | A | 9/1988 | Reinhardt |
| 6,557,631 | B1 | 5/2003 | Spencer et al. |
| 6,675,897 | B1 | 1/2004 | McGarian et al. |

(Continued)

OTHER PUBLICATIONS

Workover Solutions; "Bit SavR™", company product webpage via https://workoversolutions.com, dated 2020, 3 pages.

(Continued)

*Primary Examiner* — Tara Schimpf
*Assistant Examiner* — Lamia Quaim
(74) *Attorney, Agent, or Firm* — Smith IP Services, P.C.

(57) ABSTRACT

A compression indication tool can include a flow passage and a valve that in a closed configuration prevents fluid communication between the flow passage and an exterior of the tool, and in an open configuration permits fluid communication between the flow passage and the exterior of the tool. The valve is opened in response to application of a predetermined longitudinal compressive load to the compression indication tool. A method can include connecting a compression indication tool in a tool string, the tool including a valve that prevents fluid communication between an interior flow passage and an exterior of the tool, deploying the tool string into the well, and applying a predetermined longitudinal compressive load to the tool string, thereby opening the valve to permit fluid communication between the interior flow passage and the exterior of the tool.

22 Claims, 7 Drawing Sheets

(51) Int. Cl.
*E21B 34/12* (2006.01)
*E21B 47/007* (2012.01)

(56) References Cited

U.S. PATENT DOCUMENTS

| | | | |
|---|---|---|---|
| 10,544,637 | B2 | 1/2020 | Cramer et al. |
| 11,261,681 | B1 | 3/2022 | Von Gynz-Rekowski et al. |
| 2015/0096807 | A1* | 4/2015 | Strilchuk ..... E21B 21/103 175/57 |
| 2016/0290100 | A1* | 10/2016 | Williamson, Jr. ..... E21B 43/12 |
| 2018/0112466 | A1 | 4/2018 | Von Gynz-Rekowski |
| 2019/0024459 | A1 | 1/2019 | Sicilian et al. |
| 2022/0136346 | A1 | 5/2022 | Von Gynz-Rekowski et al. |

OTHER PUBLICATIONS

Canadian Office Action issued Jan. 25, 2023 for CA Patent Application No. 3,143,607, 4 pages.

* cited by examiner

INDICATION OF COMPRESSION LOADING IN DOWNHOLE TOOL STRINGS

CROSS-REFERENCE TO RELATED APPLICATION

This application claims the benefit of the filing date of U.S. provisional application No. 63/135,454 filed on 8 Jan. 2021. The entire disclosure of the prior application is incorporated herein by this reference.

BACKGROUND

This disclosure relates generally to equipment utilized and operations performed in conjunction with a subterranean well and, in examples described below, more particularly provides for indication of compression in downhole tool strings.

In various different types of well operations, it can be useful to know whether sufficient compression loading is being applied to a tool string downhole. For example, in drilling operations, such compression loading relates to "weight on bit," which is needed for cutting into the earth by a drill bit.

It will, therefore, be readily appreciated that improvements are continually needed in the art of indicating compression loading in downhole tool strings. Such improvements may be useful in a variety of different well operations, such as drilling, completion, stimulation, injection and other types of operations.

DETAILED DESCRIPTION

Figure 1:
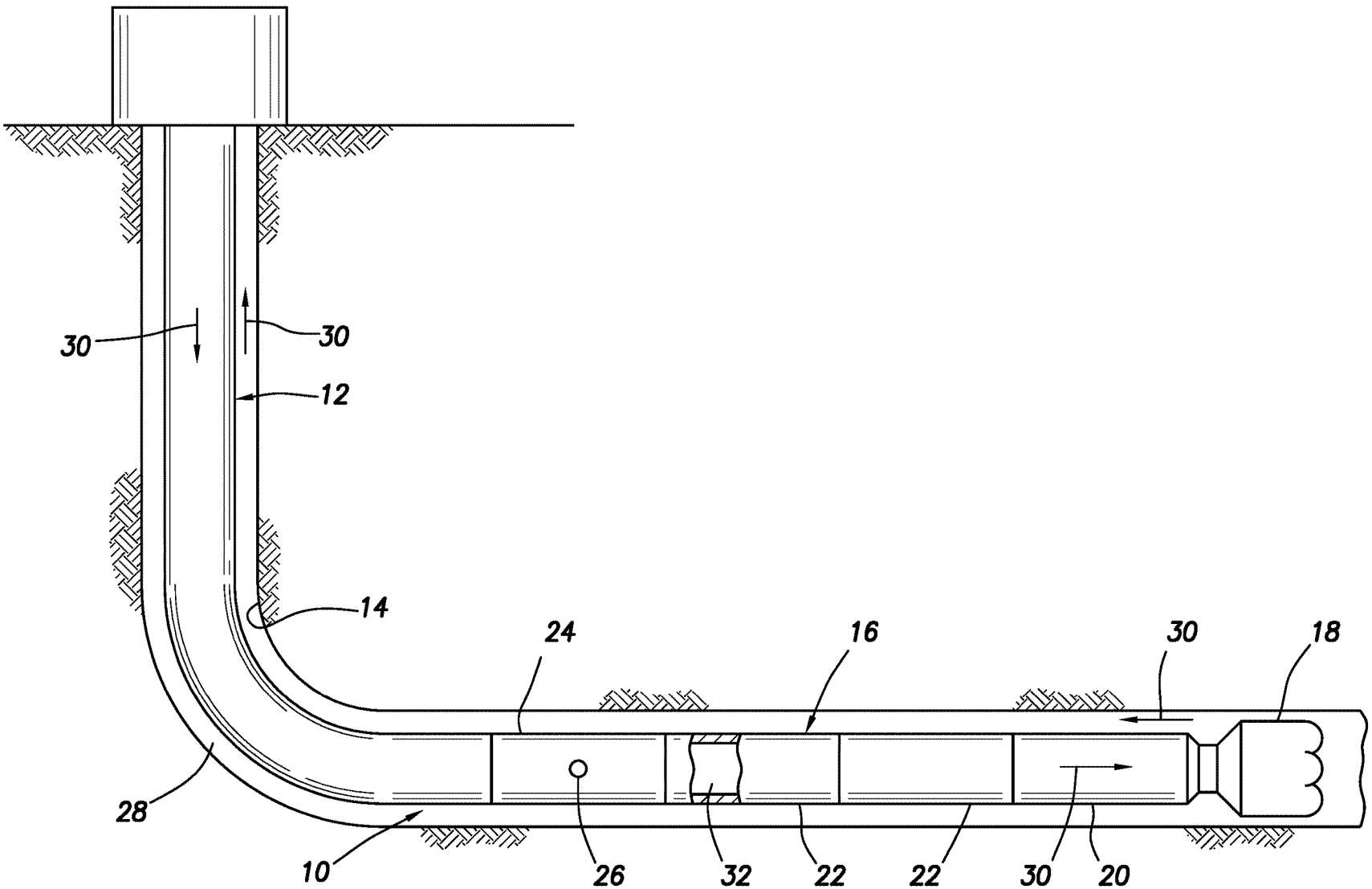
FIG. 1 is a representative partially cross-sectional view of an example of a well system and associated method which can embody principles of this disclosure.

Representatively illustrated in the accompanying drawings are examples of downhole tool string compression loading indication systems, methods and apparatus which can embody principles of this disclosure. However, it should be clearly understood that the particularly described systems, methods and apparatus are merely examples of an application of the principles of this disclosure in practice, and a wide variety of other examples are possible. Therefore, the scope of this disclosure is not limited at all to the details of the systems, methods and apparatus described herein and/or depicted in the drawings.

Referring to FIG. 1, an example of a system 10 for use with a subterranean well is representatively illustrated. In this example, a drill string 12 is positioned in a wellbore 14, in order to elongate the wellbore by drilling further into the earth.

A tool string 16 of the type known to those skilled in the art as a bottom hole assembly (BHA) is connected at a distal end of, and forms a lower section of, the drill string 12. In this example, the tool string 16 includes a drill bit 18, a drill motor 20, various logging and communication tools 22, and a compression indication tool 24. However, the scope of this disclosure is not limited to any particular tools or combination of tools in a BHA.

The tool string 16 is positioned in a generally horizontal section of the wellbore 14. In such situations, it can be difficult to determine whether or to what degree compression loading is being applied to the tool string 16 (for example, due to friction between the drill string 12 and the wellbore 14). It will be appreciated by those skilled in the art that, especially in drilling operations, it is very important to know the compression loading in a BHA and corresponding compressive force applied to the drill bit, at least because this affects a rate of penetration of the drill bit into the earth and can affect other functions/capabilities (such as, steering of the drill bit, bit wear, etc.).

Note that, although FIG. 1 depicts a drilling operation, the scope of this disclosure is not limited to drilling operations in horizontal wellbore sections or use of the compression indication tool 24 in any particular type of tool string. The compression indication tool 24 could, for example, be used in completion, stimulation, workover, or other types of operations in vertical, inclined or any other orientation wellbores.

In the FIG. 1 example, the compression indication tool 24 includes a port 26 that selectively provides fluid communication between an internal flow passage 32 extending longitudinally through the tool string 16 and an annulus 28 formed between the tool string and the wellbore 14. During normal drilling operations, fluid 30 is circulated through the drill string 12. The fluid 30 flows through the flow passage 32 in the tool string 16 and exits the drill bit 18 into the annulus 28 for return to the surface. There typically is a significant pressure drop from the flow passage 32 to the annulus 28, due in part to flow restrictions in the tool string 16 (particularly in the communication tools 22, the drill motor 20 and nozzles in the drill bit 18).

However, in the FIG. 1 system 10, the compression indication tool 24 is actuated to permit fluid communication between the flow passage 32 and the annulus 28 when a predetermined compressive load is applied to the tool string 16. This fluid communication reduces the pressure drop from the flow passage 32 to the annulus 28. Thus, an operator at the surface can detect a reduction in pressure applied to the drill string 12 when the predetermined compressive load is applied to the tool string 16.

In some examples, the compression indication tool 24 can be used to determine when the tool string 16 has been "set down" at a distal end of the wellbore 14, so that drilling into the earth can commence. In other examples, the compression indication tool 24 can be used to determine whether a tool string 16 has engaged a nipple, lock coupling, shifting profile, shoulder or other profile in a well. The scope of this disclosure is not limited to any particular purpose for indicating compression loading in a tubular string (such as, the drill string 12 or a completion, workover, stimulation, injection or other type of tubular string) in a well.

Figure 2:
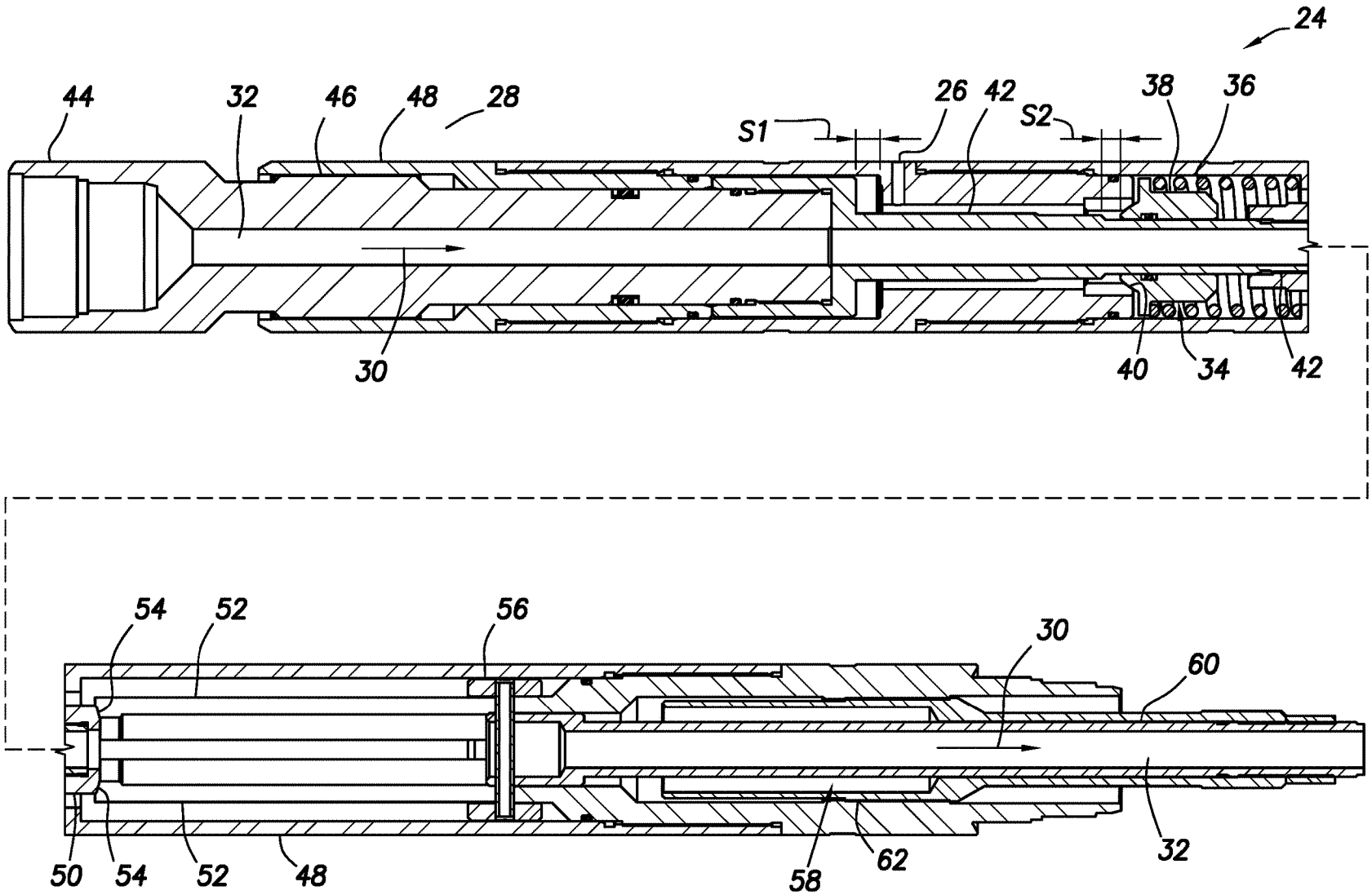
FIG. 2 is a representative cross-sectional view of an example of a compression indication tool that may be used in the FIG. 1 system and method, the compression indication tool being depicted in a closed run-in configuration.

Referring now to FIG. 2, a more detailed view of one example of the compression indication tool 24 is representatively illustrated. In this view, the compression indication tool 24 is in a run-in configuration in which the predetermined compressive load is not applied to the tool. The FIG. 2 compression indication tool 24 may be used with the system 10 and method of FIG. 1, or it may be used with other systems and methods.

The flow passage 32 extends longitudinally through the tool 24. A poppet valve 34 initially prevents fluid communication between the flow passage 32 and an exterior of the tool 24 (corresponding to the annulus 28 in the FIG. 1 example). However, when the poppet valve 34 is opened, fluid 30 can flow from the flow passage 32 to the exterior of the tool 24 via the port 26.

The poppet valve 34 in this example includes an annular closure member 38 that is initially biased toward a closed position by a compression spring or other biasing device 36 (such as, a compressed gas chamber, an elastomer, a compressible liquid, etc.). When the tool 24 is in tension or the predetermined compressive load is not applied to the tool, the poppet valve closure member 38 is sealingly engaged with an annular valve seat 40.

An inner mandrel 42 extends longitudinally through the poppet valve closure member 38 and valve seat 40. The inner mandrel 42 extends longitudinally from an upper connector 44 having an axially splined connection 46 with an outer housing assembly 48 of the tool 24. A tapered collet prop 50 is connected at an opposite end of the inner mandrel 42.

The splined connection 46 allows torque to be transmitted between the upper connector 44 and the outer housing assembly 48, and permits axial displacement of the upper connector relative to the outer housing assembly. Displacement of the upper connector 44 to the right (as viewed in FIG. 2) relative to the outer housing assembly 48 is resisted by abutting engagement between the tapered collet prop 50 and upper ends of multiple flexible collets 52.

However, when a sufficient compressive load is applied across the tool 24, the collets 52 will flex radially outward (due to the tapered surfaces 54 formed on the collet prop 50 and the upper ends of the collets). This outward flexing of the collets 52 will allow the collet prop 50, the inner mandrel 42 and the upper connector 44 to displace somewhat to the right as viewed in FIG. 2.

This rightward displacement is limited by a longitudinal spacing S1 between shoulders formed on the inner mandrel 42 and in the outer housing assembly 48. A smaller longitudinal spacing S2 exists between an upper end of the poppet valve closure member 38 and an annular shoulder formed on the inner mandrel 42. Thus, the annular shoulder on the inner mandrel 42 will engage and displace the poppet valve closure member 38 rightward before the inner mandrel shoulders up against the interior shoulder in the outer housing assembly 48. This will open the poppet valve 34 and permit fluid communication between the flow passage 32 and the exterior of the tool 24.

Figure 3:
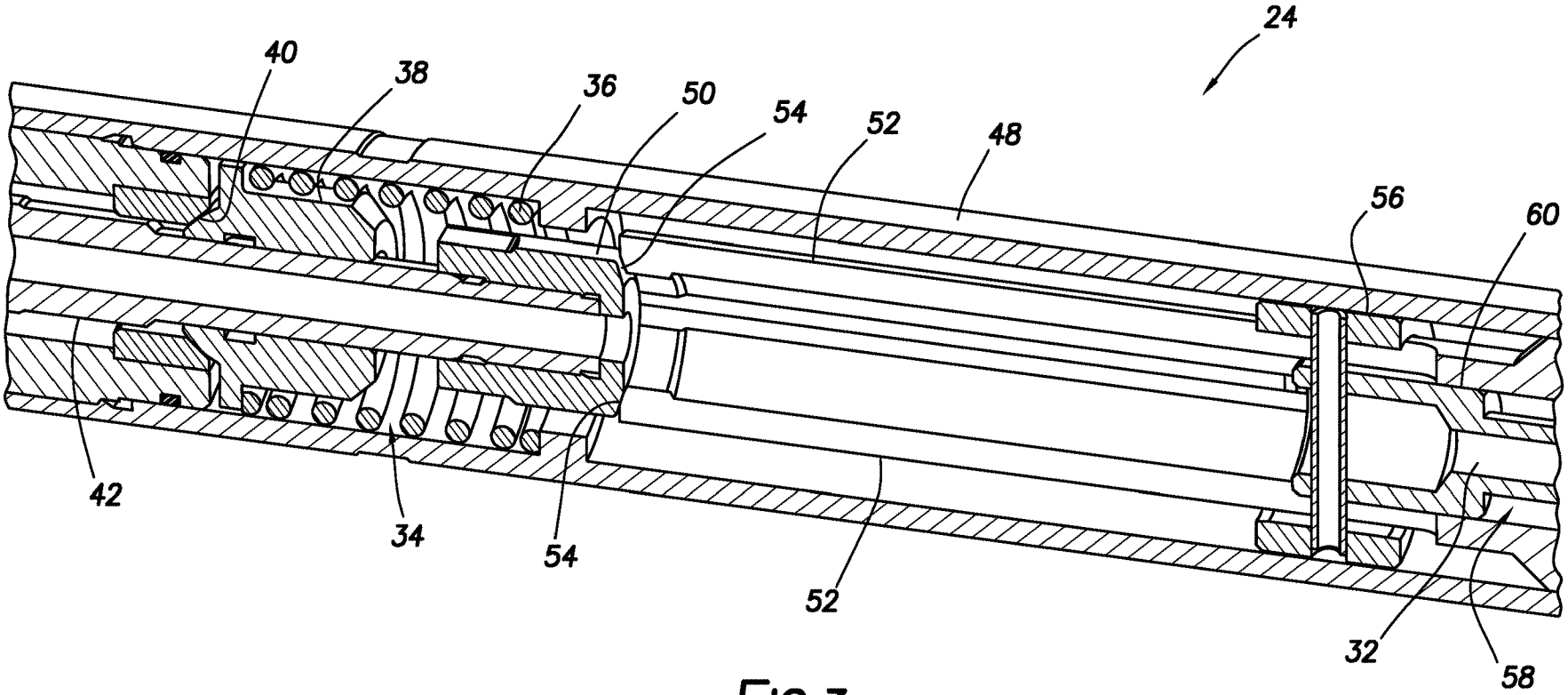
FIG. 3 is a representative cross-sectional perspective view of a valve and flexible member section of the FIG. 2 compression indication tool depicted in an open actuated configuration.

A more detailed view of an example of the poppet valve 34, collet prop 50 and collets 52 is depicted in FIG. 3. Note that the predetermined compressive load at which the poppet valve 34 opens can be varied in a variety of different ways. For example, a stiffness of the collets 52 can be varied by varying a strength of a material of which the collets are made, or by varying a size (e.g., width, thickness, length, etc.) or other property (e.g., second moment of area, etc.) of the collets. As another alternative, the tapered surfaces 54 formed on the collets 52 and the collet prop 50 can be varied.

Figure 4:
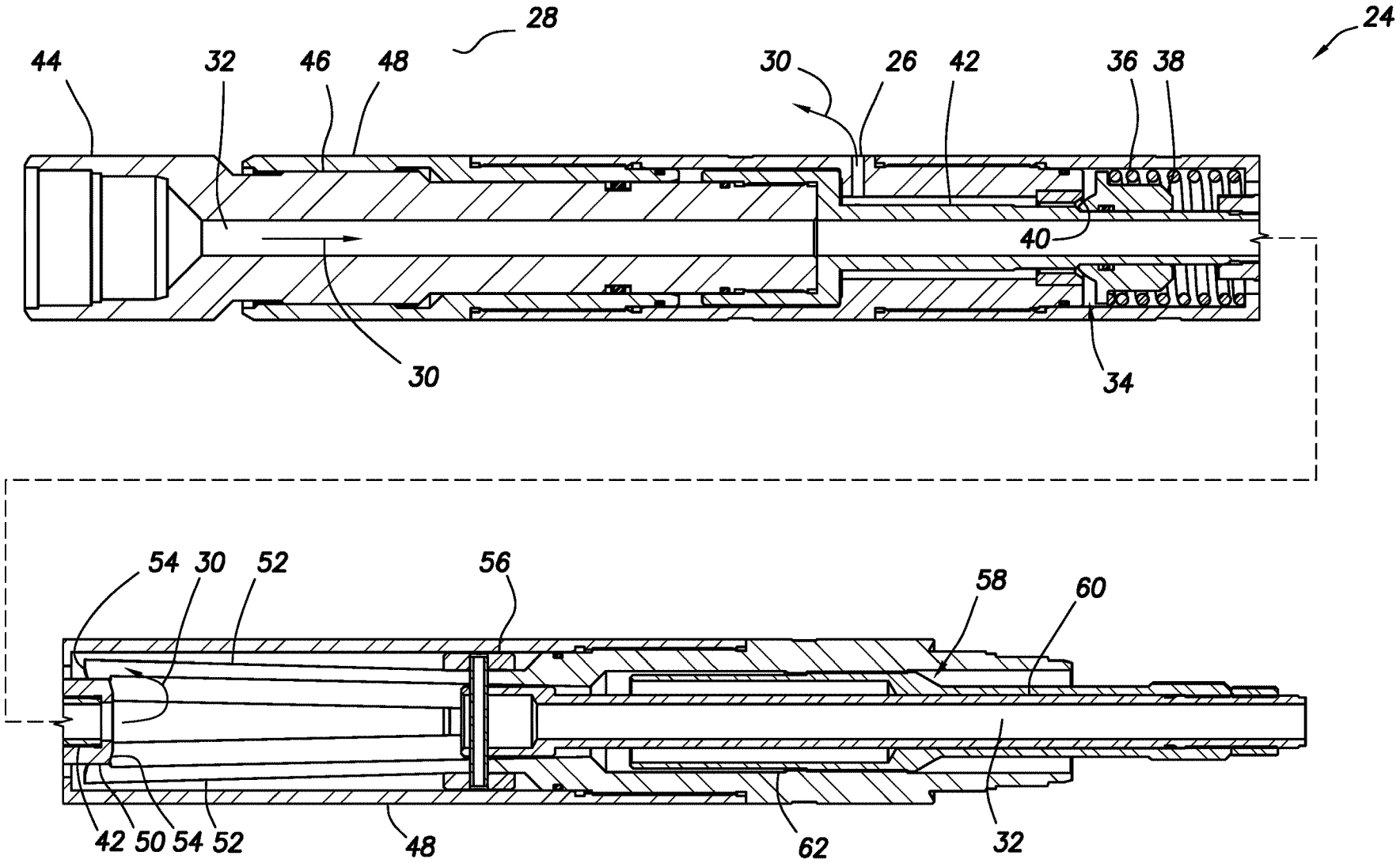
FIG. 4 is a representative cross-sectional view of the FIG. 2 compression indication tool depicted in an open actuated configuration.

Referring additionally now to FIG. 4, the compression indication tool 24 is depicted after the predetermined compressive load has been applied to the tool. Note that the poppet valve 34 is now open (the closure member 38 no longer sealing against the valve seat 40), so that fluid communication is now permitted between the flow passage 32 and the exterior of the tool 24 via the port 26.

The collets 52 have been deflected radially outward by the collet prop 50. This allows the inner mandrel 42 to displace to the right (as viewed in FIG. 4) and thereby open the poppet valve 34. Thus, the fluid 30 can flow between the closure member 38 and the valve seat 40.

The tool 24 can be returned to the closed configuration by reducing the compressive load applied to the tool (or by applying tension to the tool), so that the poppet valve closure member 38 is displaced back to its closed position in sealing engagement with the valve seat 40.

As mentioned above, the predetermined compressive load at which the poppet valve 34 opens can be varied by varying a characteristic of the collets 52. In the FIGS. 2-4 example, an effective flexible length of the collets 52 can be varied by displacing a ring 56 relative to the collets. This allows the predetermined compressive load to be conveniently adjusted, for example, at a well site when actual well conditions are known or have changed, without requiring disassembly of the tool 24.

The ring 56 can be displaced relative to the collets 52 by turning an adjustment mechanism 58 (including left-hand and right-hand threaded members 60, 62), so that the ring is displaced longitudinally along an exterior of the collets. As depicted in FIG. 4, an effective bending length of the collets 52 is decreased when the ring 56 is displaced to the left, and the effective bending length of the collets is increased when the ring is displaced to the right. A longer effective bending length provides increased flexibility and reduced stiffness (and, thus, reduced predetermined compressive load to open the poppet valve 34), and a shorter effective bending length provides increased stiffness and reduced flexibility (and, thus, increased predetermined compressive load to open the poppet valve).

Figure 5:
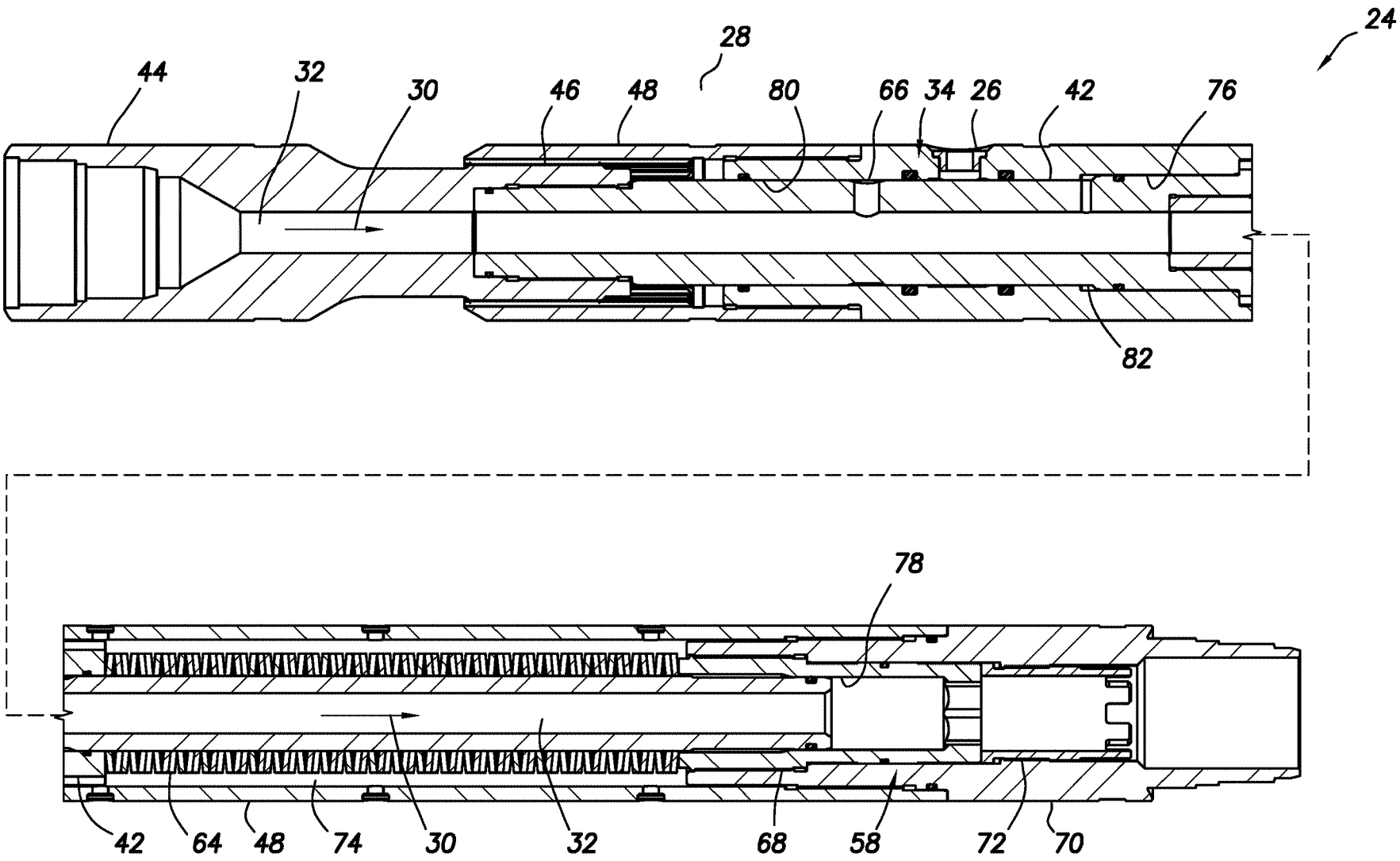
FIG. 5 is a representative cross-sectional view of another example of the compression indication tool depicted in a closed run-in configuration.
Figure 6:
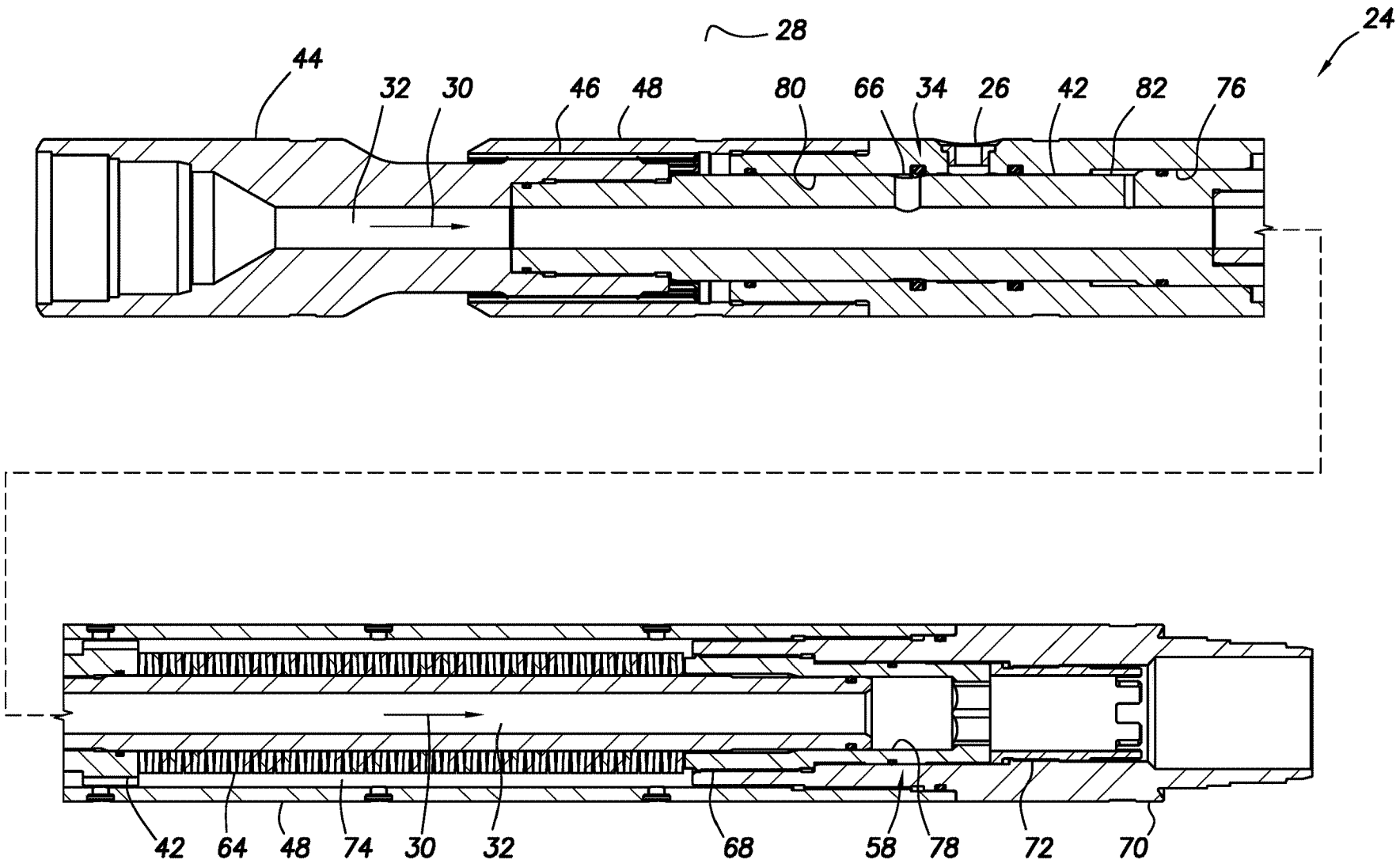
FIG. 6 is a representative cross-sectional view of the FIG. 5 compression indication tool depicted in a partially actuated configuration.
Figure 7:
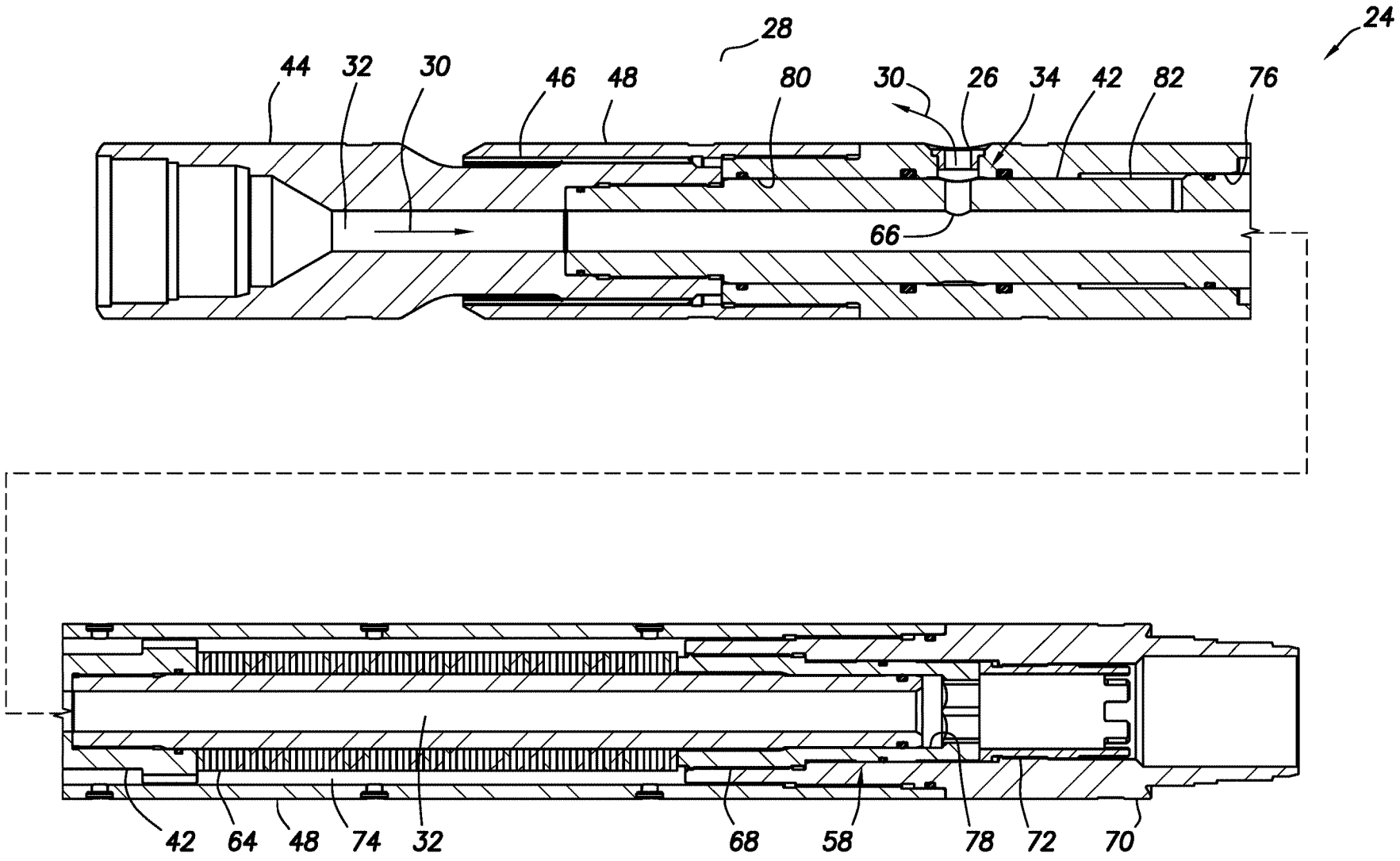
FIG. 7 is a representative cross-sectional view of the FIG. 5 compression indication tool depicted in a fully open actuated configuration.

A cross-sectional view of another example of the compression indication tool 24 is representatively illustrated in FIGS. 5-7. This example is similar in some respects to the FIGS. 2-4 example. However, instead of forcing the collet prop 50 into the collets 52 in order to open the poppet valve 34 as in the FIGS. 2-4 example, in the FIGS. 5-7 example springs (or another biasing device 64) are longitudinally compressed in order to align an opening 66 in the inner mandrel 42 with the port 26, thereby permitting fluid communication between the flow passage 32 and the exterior of the tool 24.

The combination of the inner mandrel 42 and the opening 66, and the outer housing assembly 48 and the port 26, is similar to a sliding sleeve valve. In the FIG. 5 run-in configuration, the inner mandrel 42 is in a closed position with respect to the outer housing assembly 48 (the sliding sleeve valve is closed). In FIG. 6, a longitudinal compressive load is being applied to the compression indication tool 24, but the valve 34 is not yet fully opened. In the FIG. 7 actuated configuration, the inner mandrel 42 is in an open position with respect to the outer housing assembly 48 (the sliding sleeve valve 34 is open).

When a predetermined compressive load is applied to the tool 24, the springs or other biasing device 64 will longitudinally compress and the inner mandrel 42 will displace from the closed position to the open position. The level of the predetermined compressive load can be adjusted by varying the spring rate of the springs, by varying a number of the springs (in this example Bellville washer springs), by varying a compressive preload in the springs, etc.

A compressive preload in the springs or other biasing device 64 can be conveniently adjusted (for example, at a well site when actual well conditions are known or have changed) by turning an externally threaded adjustment sleeve 68 in a lower connector 70 of the tool 24. An externally threaded lock sleeve 72 is used to bind against the adjustment sleeve 68 when it is positioned as desired. The adjustment sleeve 68 and the lock sleeve 72 can be rotated using tools (not shown) inserted into an end of the lower connector 70, without requiring disassembly of any portion of the tool 24.

Note that an annular chamber 74 is formed radially between two seal bores 76, 78. The annular chamber 74 is exposed to fluid pressure on the exterior of the tool (the annulus 28 in the FIG. 1 example). An annular chamber 82 between the seal bore 76 and a seal diameter or seal bore 80 is exposed to fluid pressure in the flow passage 32.

When fluid 30 is circulating through the tool string 16 (in the FIG. 1 example), and the compression indication tool 24 is in its FIG. 5 closed configuration (the predetermined compressive load is not applied), fluid pressure in the flow passage 32 will be greater than fluid pressure on the exterior of the tool. The seal bores 76, 78, 80 depicted in FIG. 5 are configured so that the greater pressure in the flow passage 32 acting on the differential areas results in a force acting to elongate the tool 24 (i.e., to prevent compression of the tool).

However, when the valve 34 is open (see FIG. 7), the fluid pressures in the flow passage 32 and on the exterior of the tool 24 are equalized, or at least the pressure differential from the flow passage to the exterior of the tool is decreased. Thus, in the open configuration of FIG. 7, the force acting to elongate the tool 24 is decreased. This helps to maintain the tool 24 in the open configuration and prevent oscillation or "chatter" of the tool between the open and closed configurations, while the predetermined compressive load is applied to the tool.

The compression indication tool 24 can be returned to the closed configuration by reducing the compressive load applied to the tool (or by applying tension to the tool), so that the springs or other biasing device 64 can displace the inner mandrel 42 back to its closed position. The tool 24 can be actuated between its closed and open configurations multiple times while it is deployed into a wellbore.

It may now be fully appreciated that the above disclosure provides significant advancements to the art of controlling downhole operations. In examples described above, application of at least a predetermined compressive load to the tool string 16 is indicated by opening the valve 34 to permit fluid communication between the internal flow passage 32 and an annulus 28 surrounding a compression indication tool 24. In one example the valve 34 comprises a poppet valve, and in another example the valve 34 comprises a sliding sleeve valve.

A compression indication tool 24 can be connected in a tubular string (such as the drill string 16), so that fluid communication is permitted between an interior and an exterior of the tubular string in response to a predetermined compressive load being applied to the tubular string at the compression indication tool.

A method described above can include applying a predetermined compressive load to a drill string 16, observing a decrease in fluid pressure in the drill string (for example, at the surface), and then drilling ahead in response to observing the fluid pressure decrease.

A method of indicating compression loading in a tubular string 16 can include adjusting a characteristic (such as a strength of a material, a size (e.g., width, thickness, length, angle of a tapered surface, etc.) or other property (e.g., second moment of area, flexibility, stiffness, effective bending length, etc.)) of a flexible member (such as the collets 52) of a compression indication tool 24, then deploying the tool into a well, and then applying a predetermined compressive load to the tool to indicate the compression loading to an operator. The predetermined compressive load is determined at least in part by the adjustment to the characteristic of the flexible member.

A compression loading indication system, method and apparatus are also described above, in which a hydraulic area (such as, the areas defined by the seal bores 76, 78, 80) in a compression indication tool 24 resists longitudinal compression of the tool. A pressure differential applied from the internal flow passage 32 to the annulus 28 or exterior of the tool 24 acts to maintain an elongated configuration of the tool.

The pressure differential is reduced when the tool 24 is longitudinally compressed. Fluid communication is permitted between the interior and the exterior of the tool 24 in response to the longitudinal compression of the tool.

A compression loading indication system, method and apparatus are described above, in which a predetermined compressive load required to actuate a compression indication tool 24 is adjustable without disassembling the compression indication tool. For example, the threaded members 60, 62 are externally accessible in the FIGS. 2-4 compression indication tool 24 example, and the adjustment sleeve 68 and lock sleeve 72 are externally accessible in the FIGS. 5-7 compression indication tool 24 example.

The predetermined compressive load may be adjustable by varying a stiffness of a flexible member (such as the collets 52). The predetermined compressive load may be adjustable by varying a preload in a spring or other biasing device 64. The predetermined compressive load may be adjustable by insertion of a tool into an end of the compression indication tool 24 and rotating an adjustment member (such as the threaded members 60, 62 or the adjustment sleeve 68).

The above disclosure provides to the art a compression indication tool 24 for use in a subterranean well. In one example, the compression indication tool 24 comprises a flow passage 32 that extends longitudinally through the compression indication tool 24, and a valve 34 that in a closed configuration prevents fluid communication through the valve 34 between the interior flow passage 32 and an exterior of the compression indication tool 24, and in an open configuration permits fluid communication through the valve 34 between the interior flow passage 32 and the exterior of the compression indication tool 24. The valve 34 is actuated from the closed configuration to the open configuration in response to application of a predetermined longitudinal compressive load to the compression indication tool 24.

A longitudinal length of the compression indication tool 24 may be shortened in response to the application of the predetermined longitudinal compressive load.

The valve 34 may comprise a poppet valve. The poppet valve 34 may comprise an annular closure member 38 that sealingly engages an annular seat 40 in the closed configuration. The valve 34 may comprise a sliding sleeve valve.

The compression indication tool 24 may include a flexible member (such as the collets 52) that resists longitudinal compression of the compression indication tool 24. The predetermined longitudinal compressive load may be variable in response to a variation in a characteristic of the flexible member 52.

The characteristic may comprise a flexibility of the flexible member 52. The flexibility of the flexible member 52 may be variable from the exterior of the compression indication tool 24. The characteristic may comprise an angle of a tapered surface 54 on the flexible member 52.

The compression indication tool 24 may comprise a biasing device 64 that resists longitudinal compression of the compression indication tool 24. The predetermined longitudinal compressive load may be variable in response to a variation in at least one of a spring rate and a preload of the biasing device 64.

Longitudinal compression of the compression indication tool 24 may be resisted in response to a pressure differential from the interior flow passage 32 to the exterior of the compression indication tool 24. Multiple seal bores 76, 78, 80 of the compression indication tool 24 may be configured so that a pressure differential from the interior flow passage 32 to the exterior of the compression indication tool 24 acting on annular chambers 74, 82 between the seal bores 76, 78, 80 resists longitudinal compression of the compression indication tool 24.

A method for use with a subterranean well is also provided to the art by the above disclosure. In one example, the method may comprise: connecting a compression indication tool 24 in a tool string 16, the compression indication tool 24 comprising a valve 34 that prevents fluid communication through the valve 34 between an interior flow passage 32 and an exterior of the compression indication tool 24; deploying the tool string 16 into the well; and applying a predetermined longitudinal compressive load to the tool string 16, thereby opening the valve 34 to permit fluid communication through the valve 34 between the interior flow passage 32 and the exterior of the compression indication tool 24.

The applying step may comprise observing a decrease in fluid pressure applied to the tool string 16. The applying step may comprise decreasing a pressure differential from the interior flow passage 32 to the exterior of the compression indication tool 24. The method may comprise applying the pressure differential from the interior flow passage 32 to the exterior of the compression indication tool 24 prior to the step of applying the predetermined longitudinal compressive load.

The applying step may comprise deflecting a flexible member 52 of the compression indication tool 24. The deflecting step may comprise radially outwardly deflecting the flexible member 52. The method may include adjusting a characteristic of the flexible member 52, thereby varying the predetermined longitudinal compressive load.

The applying step may comprise longitudinally compressing a biasing device 64 of the compression indication tool 24. The method may comprise adjusting a preload of the biasing device 64, thereby varying the predetermined longitudinal compressive load.

The applying step may comprise decreasing a longitudinal length of the compression indication tool 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A compression indication tool for use in a subterranean well, the compression indication tool comprising:

an interior flow passage that extends longitudinally through the compression indication tool; and a valve that in a closed configuration prevents fluid communication through the valve between the interior flow passage and an exterior of the compression indication tool, and in an open configuration permits fluid communication through the valve between the interior flow passage and the exterior of the compression indication tool, in which the compression indication tool is configured for interconnection in a tubular string, in which application of a predetermined longitudinal compressive load to the tubular string causes the valve to shift from the closed configuration to the open configuration, and in which multiple seal bores of the compression indication tool are configured so that a pressure differential from the interior flow passage to the exterior of the compression indication tool acting on annular chambers between the seal bores resists longitudinal compression of the compression indication tool.

2. The compression indication tool of claim 1, in which a longitudinal length of the compression indication tool is shortened in response to the application of the predetermined longitudinal compressive load.

3. The compression indication tool of claim 1, in which the valve comprises a poppet valve.

4. The compression indication tool of claim 3, in which the poppet valve comprises an annular closure member that sealingly engages an annular seat in the closed configuration.

5. The compression indication tool of claim 1, in which the valve comprises a sliding sleeve valve.

6. The compression indication tool of claim 1, further comprising a flexible member that resists longitudinal compression of the compression indication tool.

7. The compression indication tool of claim 6, in which the flexible member comprises at least one collet.

8. The compression indication tool of claim 6, in which the predetermined longitudinal compressive load is variable in response to a variation in a characteristic of the flexible member.

9. The compression indication tool of claim 8, in which the characteristic comprises a flexibility of the flexible member.

10. The compression indication tool of claim 9, in which the flexibility of the flexible member is variable from the exterior of the compression indication tool.

11. The compression indication tool of claim 8, in which the characteristic comprises an angle of a tapered surface on the flexible member.

12. The compression indication tool of claim 1, further comprising a biasing device that resists longitudinal compression of the compression indication tool.

13. The compression indication tool of claim 12, in which the predetermined longitudinal compressive load is variable in response to a variation in at least one of the group consisting of a spring rate and a preload of the biasing device.

14. The compression indication tool of claim 1, in which longitudinal compression of the compression indication tool is resisted in response to a pressure differential from the interior flow passage to the exterior of the compression indication tool.

15. A method for use with a subterranean well, the method comprising:

connecting a compression indication tool in a tubular string, the compression indication tool comprising a valve that prevents fluid communication through the valve between an interior flow passage and an exterior of the compression indication tool;

deploying the tubular string into the well; and applying a predetermined longitudinal compressive load to the tubular string, thereby opening the valve to permit fluid communication through the valve between the interior flow passage and the exterior of the compression indication tool, in which the applying comprises deflecting a flexible member of the compression indication tool, and in which the deflecting comprises radially outwardly deflecting the flexible member.

16. The method of claim 15, in which the applying comprises observing a decrease in fluid pressure applied to the tubular string.

17. The method of claim 15, in which the applying comprises decreasing a pressure differential from the interior flow passage to the exterior of the compression indication tool.

18. The method of claim 17, further comprising applying the pressure differential from the interior flow passage to the exterior of the compression indication tool prior to the applying the predetermined longitudinal compressive load.

19. The method of claim 15, further comprising adjusting a characteristic of the flexible member, thereby varying the predetermined longitudinal compressive load.

20. The method of claim 15, in which the applying comprises longitudinally compressing a biasing device of the compression indication tool.

21. The method of claim 20, further comprising adjusting a preload of the biasing device, thereby varying the predetermined longitudinal compressive load.

22. The method of claim 15, in which the applying comprises decreasing a longitudinal length of the compression indication tool.

* * * * *